US006095632A

United States Patent [19]

Kobayashi et al.

[11] Patent Number: 6,095,632

[45] Date of Patent: Aug. 1, 2000

[54] INK JET RECORDING APPARATUS

[75] Inventors: Atsushi Kobayashi; Seiji Mochizuki; Masahiro Isono, all of Nagano, Japan

[73] Assignee: Seiko Epson Corporation, Tokyo, Japan

[21] Appl. No.: 08/980,378

[22] Filed: Nov. 28, 1997

[30] Foreign Application Priority Data

Nov. 28, 1996 [JP] Japan ..... 8-332936
Sep. 29, 1997 [JP] Japan ..... 9-282870

[51] Int. Cl.[7] ..... B41J 2/165

[52] U.S. Cl. ..... 347/23

[58] Field of Search ..... 347/22, 5, 23, 347/29, 30, 33, 34

[56] References Cited

U.S. PATENT DOCUMENTS

| | | | |
|---|---|---|---|
| 5,341,163 | 8/1994 | Hanabusa | 347/23 |
| 5,475,404 | 12/1995 | Takahashi et al. | 347/23 |
| 5,781,207 | 7/1998 | Hasegawa et al. | 347/23 |

FOREIGN PATENT DOCUMENTS

| | | | |
|---|---|---|---|
| 0 442 438 | 8/1991 | European Pat. Off. | B41J 2/165 |
| 0 579 490 | 1/1994 | European Pat. Off. | B41J 2/165 |
| 7-57551 | 6/1995 | Japan | B41J 29/28 |

OTHER PUBLICATIONS

Patent Abstracts of Japan vol. 011, No. 076 (M–569), Mar. 7, 1987 & JP 61 230942 A (Tokyo Electric Co., Ltd.) Oct. 15, 1986 *Abstract.

Patent Abstracts of Japan vol. 018, No. 243 (M–1602), May 10, 1994 & JP 06 031929 A (Canon Inc) Feb. 8, 1994 *Abstract.

Patent Abstracts of Japan vol. 018, No. 206 (M–1591), Apr. 12, 1994, & JP 06 008458 A (Canon Inc) Jan. 18, 1994 *Abstract.

Patent Abstracts of Japan vol. 017, No. 439 (M–1462), Aug. 13, 1993 & JP 05 096747 A (Canon Inc) Apr. 20, 1993 *Abstract.

Patent Abstracts of Japan vol. 007, No. 145 (M–224), Jun. 24, 1983 & JP 58 056863 A (Epuson KK; Others: 01) Apr. 4, 1983 *Abstract.

Patent Abstracts of Japan vol. 015, No. 400 (M–1167), Oct. 11, 1991 & JP 03 164261 A (NEC Data Terminal Ltd) Apr. 16, 1991 *Abstract.

*Primary Examiner*—N. Le
*Assistant Examiner*—Anh T. N. Vo
*Attorney, Agent, or Firm*—Sughrue, Mion, Zinn, Macpeak & Seas, PLLC

[57] ABSTRACT

An ink jet recording apparatus comprising: an ink jet recording head having a discharging orifice, for discharging ink droplets through the discharging orifice; a carriage for moving the recording head to a recording section and a capping position; a capping member for sealingly capping the recording head; a suction pump for applying a negative pressure to the capping member; a power switch; power source control means for controlling the supply of electric power from a power source circuit in response to the power switch; power-off time detecting means for detecting a time elapsing after an instruction to stop the supply of electric power is issued by the power switch; and control means for operating such that the control means compares a power-off time with a first reference time, and if the power-off time is shorter than the first reference time, the control means performs a flushing operation, and if the power-off time is longer than the first reference time, the control means moves the recording head to a position being confronted with the capping member and operates the suction pump to suck ink from the recording head.

9 Claims, 3 Drawing Sheets

INK JET RECORDING APPARATUS

BACKGROUND OF THE INVENTION

The present invention relates to an ink jet recording apparatus which ejects ink drops, in accordance with print data, from the discharging orifices of the print heads onto a recording medium, so that ink dots are arrayed, as defined by the print data, on the recording medium.

In the ink jet recording apparatus (referred to also as ink jet printer), a power switch, an on-line switch for connecting the printer to and disconnecting from a host, a cleaning switch, and the like are provided on the case of the printer, as disclosed in Examined Japanese Patent Publication No. Hei. 7-57551. The cleaning switch is used for the forcible cleaning of the print heads. As well known, the print head is provided with discharging orifices for discharging ink in the form of ink droplets. The ink at the discharging orifices is sometimes dried and solidified, so that the printer is possibly inoperable for printing. In this case, it is necessary to remove the dried and solidified ink. To this end, the cleaning switch is operated to drive the cleaning unit incorporated into the printer, whereby the print heads are forcibly cleaned by the cleaning unit.

When a paper jam occurs during the printing operation or when the user finds that the paper size or the print data is wrong, it is necessary to forcibly stop the printing operation. To this end, the user operates the switch or switches in an exceptional manner, to thereby stop the supply of data from the host to the recording device or the printer. An example of the exceptional switch operation is to simultaneously operate a plural number of switches.

When the user who is not accustomed to the operation of the printer is put in such a situation, he tends to take an action to stop the power switch or pull the plug of the power cord, in order to forcibly stop the power supply to the printer. Immediately after he removes the jammed paper or replaces the papers with other papers of correct size, he turns on the power switch.

The ink jet printer is constructed such that when the power switch is turned on, the cleaning operation is automatically executed, to prevent the nozzle blocking problem, irrespective of the paper supply process, initializing process, the length of the rest time. In the cleaning operation, the print heads are capped with the capping members, and in this state the suction pump is operated to forcibly suck ink from the print heads. If the rest time of the printer is too short to cause the nozzle blocking, the cleaning operation is automatically performed. The cleaning operation consumes much ink and time. This leads to wasteful use of ink and places the user in a long time waiting.

SUMMARY OF THE INVENTION

Accordingly, an object of the present invention is to provide an ink jet recording apparatus which may be reset merely by operating a power switch while being free from wasteful use of ink and time.

To solve the above problems, there is provided an ink jet recording apparatus comprising: an ink jet recording head having a discharging orifice, for discharging ink droplets through the discharging orifice; a carriage for moving the recording head to a recording section and a capping position; a capping member for sealingly capping the recording head; a suction pump for applying a negative pressure to the capping member; a power switch; power source control means for controlling the supply of electric power from a power source circuit in response to the power switch; power-off time detecting means for detecting a time elapsing after an instruction to stop the supply of electric power is issued by the power switch; and control means for operating such that the control means compares a power-off time with a first reference time, and if the power-off time is shorter than the first reference time, the control means performs a flushing operation, and if the power-off time is longer than the first reference time, the control means moves the recording head to a position being confronted with the capping member and operates the suction pump to suck ink from the recording head.

With such a construction, when the power off is instructed by the power switch for the reset operation, the recording heads are moved to the position being confronted with the capping member. At this position, the recording heads are caused to discharge the ink therefrom through the sucking operation by the suction pump. Therefore, the orifices of the recording heads are not clogged. If the power on is instructed before the supply of electric power is actually stopped, the recording apparatus can record even if the cleaning operation consuming much ink is skipped.

DETAILED DESCRIPTION OF THE PREFERRED EMBODIMENTS

An ink jet recording apparatus which is an embodiment of the present invention will be described with reference to the accompanying drawings.

Figure 1:
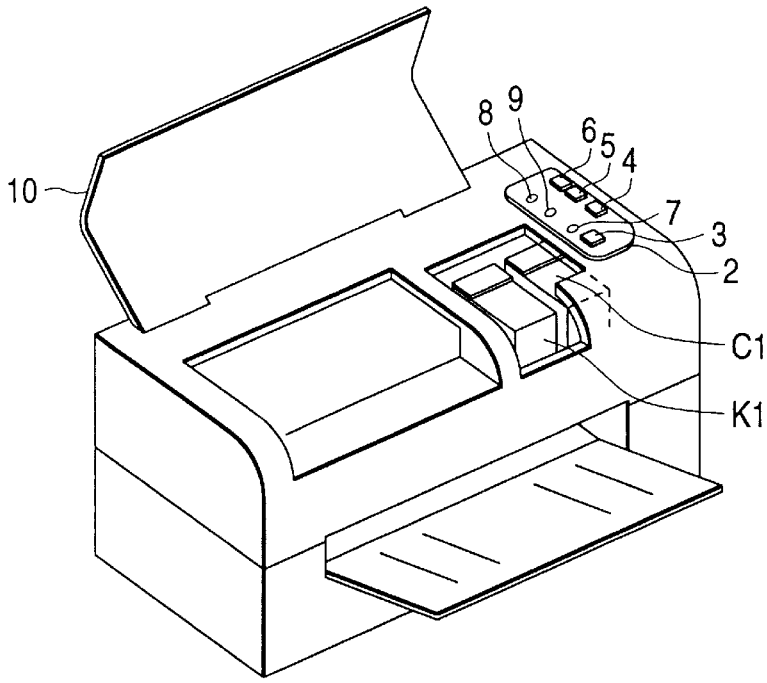
FIG. 1 is a perspective view showing an ink jet printer which constitutes embodiment of the present invention, the printer being illustrated in a state that case cover is opened.
Figure 2:
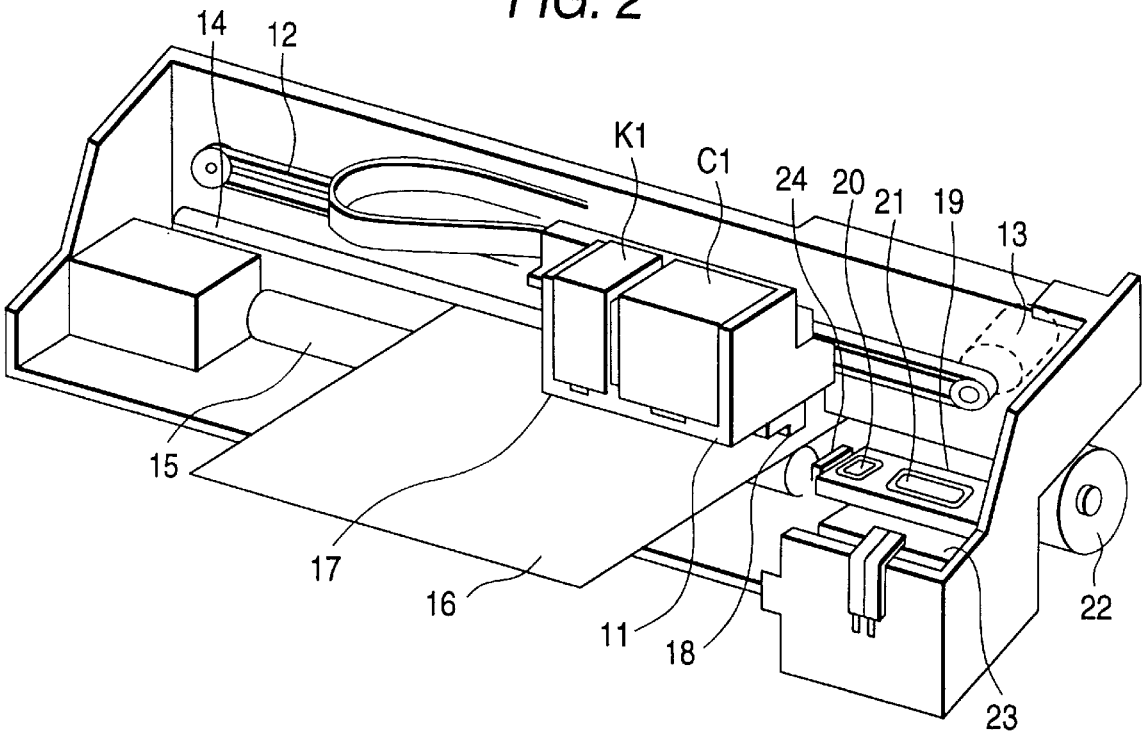
FIG. 2 a perspective view showing a printing mechanism of the ink jet printer.

FIGS. 1 and 2 cooperates to show an ink jet printer according to an embodiment of the present invention. As shown, an operation panel 2 is provided in an easily accessible portion of a case 1. The operation panel 2 includes a power switch 3, a sheet-feed switch 4, a cleaning instruction switch 5 for a black ink print head, another cleaning instruction switch 6 for a color ink print head, a power indicator 7 for indicating power supplying, and indicators 8 and 9 for indicating the print heads to be cleaned. In the figure, a cover 10 of the case 1 is provided.

A carriage 11 is coupled with a carriage drive motor 13 by a timing belt 12. The carriage 11 is reciprocatively moved in parallel with a platen 15 while being guided by a guide member 14. A print head 17 for discharging black ink and another print head 18 for discharging color ink are mounted on the carriage 11. Specifically, the print head 17 is located closer to a print section (located on the left-hand side in the drawing) of the printer, while the print head 18 is located closer to a non-print section (located on the right-hand side). A black ink cartridge K1 supplies back ink to the print head 17, and a color ink cartridge C1 supplies color ink to the print head 18. Those print heads 17 and 18 eject black and color inks in the form of ink drops to a printing medium, e.g., printing paper, 16.

A capping unit 19 is disposed in the non-print section. In the capping unit 19, a cap 20 for capping the print head 17 and a cap 21 for capping the color ink print head 18 are mounted on a slider. Those caps are coupled with a dual-pump unit 23 that is driven by a sheet-feed motor 22, by way of tubes, and independently receive negative pressures.

The caps 20 and 21 are shaped like caps made of an elastic material, e.g., rubber. Those caps are dimensioned so as to seal the orifice surfaces of the print heads 17 and 18 with closed spaces, respectively. In a non-print mode, the caps 20 and 21 seal the orifice surfaces of the print heads 17 and 18, respectively. In a discharging-capability recovering operation or when the ink cartridges K1 and C1 are replaced with new ones, the dual-pump unit 23 applies negative pressures to those print heads to forcibly discharge the inks from the heads. A cleaning unit 24 is located near to the capping unit 19. The cleaning unit 24, when driven by a drive source (not shown), presses a wiping blade against the orifice surfaces of the print heads 17 and 18.

Figure 3:
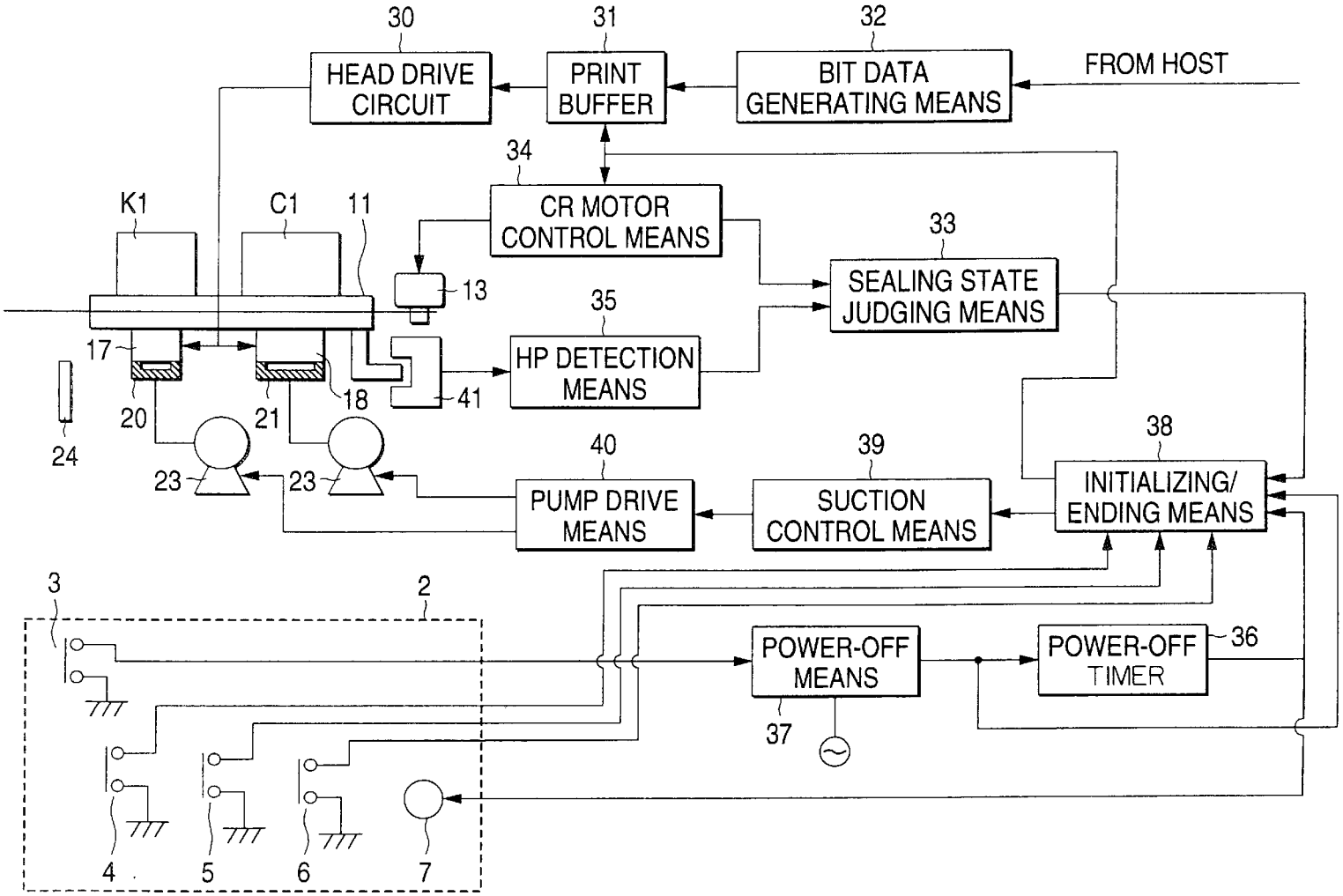
FIG. 3 is a block diagram showing a control system employed in the ink jet printer constituting the embodiment of the present invention.

FIG. 3 is a block diagram showing a control system employed in the ink jet printer constituting the embodiment of the present invention. In the control system, a bit data generating means 32 receives print data from a host computer, not shown, and converts the print data into bit map data, and stores the converted data into a print buffer 31. A head drive circuit 30 receives the bit map data from the print buffer 31, and drives the print heads 17 and 18 for causing the print heads to print in accordance with the print data and to eject ink drops through their discharging orifices for the removal of the orifice clogging.

A sealing state judging means 33 receives position data of the carriage 11 from a carriage motor control means 34 and a signal from a home position detecting means 35. The sealing state judging means 33 judges as to whether or not the print heads 17 and 18 were capped in a power off state of the printer, on the basis of those received signals.

A power-off timer 36 operates as follows. At the instant that a power-off means 37 detects a power off state, the power-off timer 36 is reset and starts its counting of time, and stops its time counting operation at the instant that the power switch is turned on. Further, the power-off timer 36 lights on the power indicator 7 when electric power is being supplied to the printer.

An initializing/ending means 38 detects the operations of the power switch 3, sheet-feed switch 4, cleaning instruction switch 5, and cleaning instruction switch 6, and executes a paper-supply initializing process, flushing process, discharge capability recovering process, and ending process. In the flushing process, the initializing/ending means 38 moves the print heads 17 and 18 to the locations being confronted with the ink receiving members (the capping members 20 and 21 in this embodiment), and causes the print heads to discharge ink through all the orifices thereof irrespective of the print data. In the discharge capability recovering process, under control of the initializing/ending means 38, the print heads are moved to the same locations, and capped with the capping members 20 and 21, respectively. A suction control means 39 and a pump drive means 40 are operated to drive the dual-pump unit 23. And the print heads are wiped or rubbed by the cleaning unit 24. The ending process is executed when the power switch 3 generates a power off instruction. In this process, the print heads 17 and 18 are capped with the capping members 20 and 21, respectively, and the supply of electric power to the printer is stopped.

In the figure, a home position detector 41 is provided.

Figure 4:
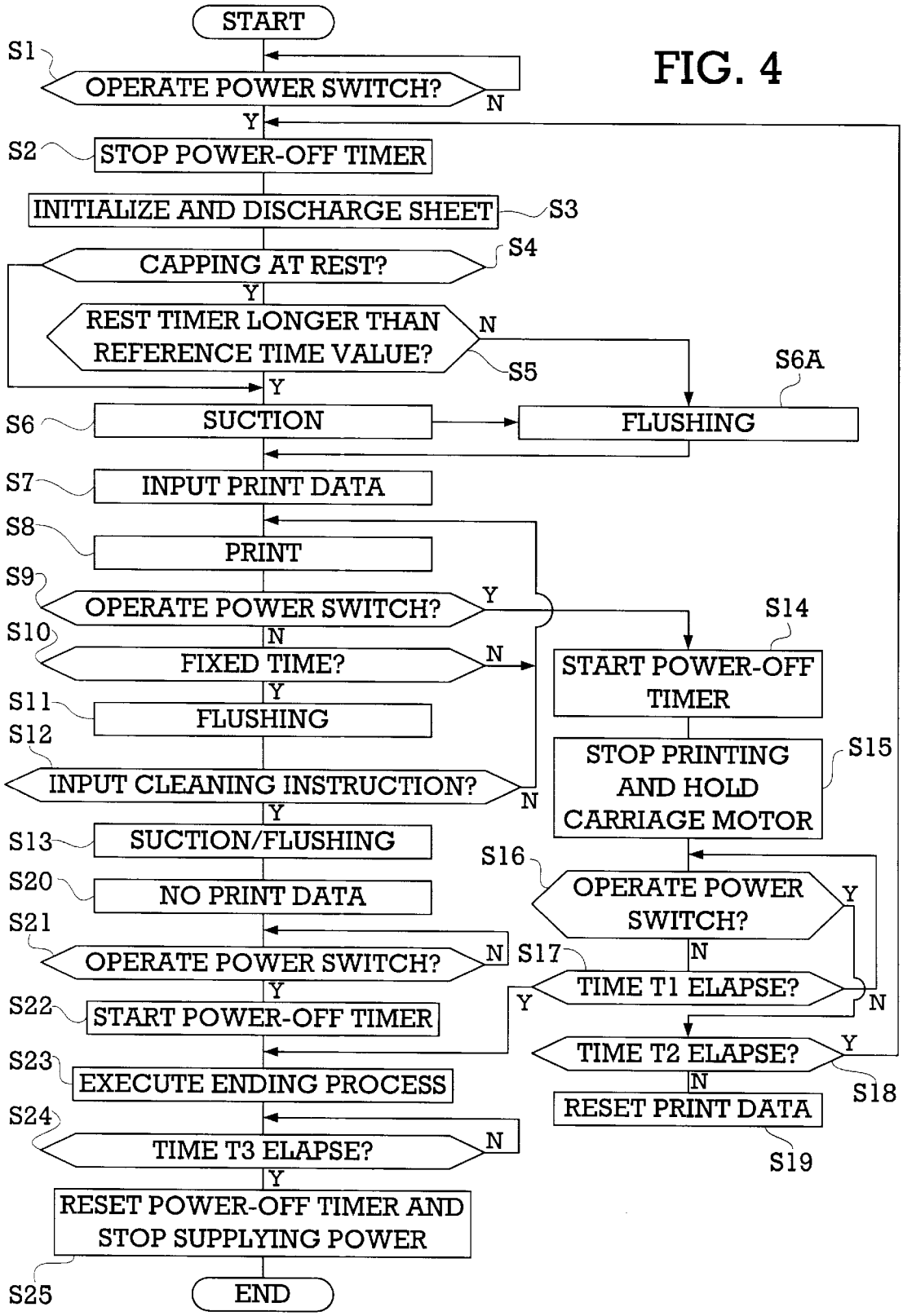
FIG. 4 is a flow chart showing an operation of the printer shown in FIG. 3.

The thus constructed control system in the printer will be described with reference to a flow chart shown in FIG. 4.

The power switch 3 on the operation panel 2 is operated (step S1) to supply electric power to the printer. The power-off means 37 detects the power on, and the power-off timer 36 stops its time counting (step S2).

The initializing/ending means 38 drives the sheet-feed motor 22 and executes the paper-supply initializing process, so that a printing paper, which is left in the print section of the printer, is discharged therefrom (step S3). The initializing/ending means 38 detects a time counted by the power-off timer 36, and receives a signal from the sealing state judging means 33 and judges as to whether or not the print heads 17 and 18 have been capped while being rested based on the signal from the received signal (step S4).

When those print heads rested in a capped state, the initializing/ending means 38 compares a time counted by the power-off timer 36 with a reference value of time (step S5). If the rest time of the print heads is longer than the reference value, the initializing/ending means performs the cleaning operation compromising the suction operation (step S6) and perform the flushing operation (step S6A) and waits for the incoming of the next data. When the print heads 17 and 18 have been resting while being not capped, the initializing/ending means immediately executes the cleaning process (step S6).

In the suction operation (step S6A), the print heads 17 and 18 are capped with the capping members 20 and 21, respectively. The suction control means 39 drives the dual-pump unit 23, to thereby cause the print heads 17 and 18 to forcibly discharge ink, by its sucking operation. Thereafter, the carriage motor control means 34 moves the carriage 11 and resiliently press the cleaning unit 24 against the print heads 17 and 18 for its wiping.

In the flushing operation (step S6), the print heads 17 and 18 are moved to the flushing positions, viz., positions being confronted with capping members 20 and 21 with a predetermined space therebetween. The print heads 17 and 18 are caused to discharge ink irrespective of print data, so that the meniscuses present in and near to the discharge orifices in the nozzles of the print heads are reshaped in preparation with the printing.

In this stage where the printer is ready for the printing, print data comes in (step S7). Then, the carriage motor control means 34 operates to move the carriage 11 in a reciprocative fashion, while at the same time the print heads 17 and 18 eject ink drops in accordance with the print data to print (step S8). The printing operation continues for a fixed time, e.g., several tens seconds (step S10). Then, a print control unit (not shown) operates the carriage motor control means 34 which in turn moves the carriage 11 to the flushing position. At this position, the flushing operation is performed (step S11) for removing or forcibly discharging from the ink of increased viscosity in and near to the discharging orifices of the print heads 17 and 18, and therefor preventing the orifice clogging.

There is a case that the user confirms that the nozzle blocking is still present and the print quality is unsatisfactory after the flushing operation is performed. In this case, the user depresses the cleaning switches 5 and 6 of the print heads 17 and 18 (step S12). In response to the depression of the cleaning switch, the initializing/ending means 38 performs the cleaning operation, and if necessary, the flushing operation to thereby removing the clogging of the discharging orifices of the print heads 17 and 18 (step S13).

During the printing process, if the user finds a print error and depresses the power switch 3 (step S9), the power-off timer 36 operates (step S14) and the print control means (not shown) operates to stop the printing operation by the print heads 17 and 18. And the carriage motor control means 34 drives the drive motor 13 to move the carriage 11, or the print heads 17 and 18 mounted thereon, to the location being confronted with the capping unit 19, and to cap the print heads 17 and 18 with the capping members 20 and 21. Further, it sends a hold drive signal to the drive motor 13 to hold the carriage 11 at the capping position (step S15).

When the print data is merely reset and the power switch 3 is turned on again within a short time (step S16), the power-off means 37 produces a signal to the power-off timer 36 which in turn stops its time counting operation (step S18). When the time counted by the power-off timer 36 is shorter than a reference value T2 of time (step S18), the initializing/ending means 38 resets the bit map data stored in the print buffer 31 (step S19) and skips to the step S7, and waits for the incoming of the print data from the host computer. At this time, the mechanical system, e.g., the printing mechanism, of the ink jet printer has been supplied with electric power. Therefore, the printer may continue the printing operation if the initializing operation of the printing mechanism, the flushing operation of the print heads 17 and 18, and the like.

When a paper jam occurs in the printer while the printer is printing (step S8), the power is turned off (step S9) and the carriage 11 is at a standstill. Then, the user removes the jammed paper or replace it with a new one by manually operating the knob or necessary parts.

When the trouble is removed and the printer is ready for the printing, the user operates the power switch 3 again (step S16). In this case, time is consumed for the paper removal and exceeds the reference time T2 (step S18). The power-off timer 36 receives a signal from the power-off means 37 to stop the time counting operation (step S2). The initializing/ending means 38 executes the paper-supply initializing process (step S3), and compares a count of the power-off timer 36 with the reference value.(step S5)

If the initializing/ending means 38 judges that a rest time is short, depending on the counted time derived from the power-off timer 36 (step S5), it skips the suction operation (step S6) consuming much ink and performs only the flushing operation as the discharge capability recovering process (step S6A). The result is the following two advantages: 1) the wasting of ink is avoided, and 2) the time for the initializing operation at the time of power on is reduced since the cleaning operation taking a relatively long time is skipped.

The printer enters the ending process to be described later (step S23) when the user finds a print error, for example, and operates the power switch 3 (step S9), and when the power switch 3 is not operated even after the power-off timer 36 counts a time T1, off e.g., 3 (three) minutes. (step S17).

When the print data ends (step S20) and the power off is instructed by the power switch 3 (step S21), the power-off timer 36 is reset by a signal from the power-off means 37 and is restarted (step S22). Then, the initializing/ending means 38 produces a signal for transmission to the carriage motor control means 34. As a result, the carriage 11 is moved to the home position, and the print heads 17 and 18 are capped with the capping members 20 and 21. That is, the ending process is thus performed (step S23).

When a count of the power-off timer 36 reaches a preset time T3 (step S24), the initializing/ending means 38 resets the power-off timer 36 and starts it again to thereby stop the power supply to other system components than the power-off timer 36 (step S25).

The above-mentioned embodiment is arranged such that the print heads 17 and 18 are sealed with the capping members 20 and 21 before the power supply is shut off in a manner that the power-off means 37 is driven, by the power switch 3, to move the carriage 11 to the capping position. In the ink jet printer of the type in which the power supply to the printer is shut off immediately after the power switch is operated, the following alternative may be employed. In particular when the power switch 3 is operated and the reset operation is carried out during the printing operation, or when the plug of the power cord is pulled out of the outlet, the sealing state judging means 33 receives signals from the carriage motor control means 34 and the home position detecting means 35, and judges whether the print heads 17 and 18 has been rested while being sealed with the capping members 20 and 21 or not being sealed therewith. If the print heads have been rested while not being sealed, a second reference value is set to be shorter than the reference value. If the time exceeds the second reference value, the cleaning operation is executed. If it is shorter than the second reference value, only the flushing operation is executed and the printer accept print data.

In the aforementioned embodiment, the timer is contained in the printer. In an alternative, time data used at the time of power off is acquired from a time stamp of the host computer and stored into a nonvolatile memory. At the time of power on, a rest time of the print heads may be obtained from a different time between the time stamp acquired from the host computer at the time of power on and the time data stored in the nonvolatile memory. The timer requiring a more complicated construction than the storage means is not used in the alternative. Therefore, the construction of the printer is simplified.

As seen from the foregoing description, an ink jet recording apparatus constructed according to the present invention includes 1) power-off time detecting means for detecting a time elapsing after the power supply is stopped by the power switch, and 2) control means for executing such a control that the control means compares a power off time with a first reference time, and if the former is shorter than the later, the control means allows a flushing operation, and if the former is longer than the latter, the control means moves the print heads to a position being confronted with the capping member and operates the suction pump to suck ink from the print head. In case of emergency, the power switch, which is intuitively and easily accessible, is merely turned off to initialize the recording device. The cleaning operation consuming much ink, which must be performed at the time of power on and off, may be omitted. This leads to the saving of the ink. Further, there is no need of using the on-line switch and the reset switch.

What is claimed is:

1. An ink jet recording apparatus comprising:

an ink jet recording head having a discharge orifice, for, discharging ink droplets through the discharge orifice;

a carriage for moving said recording head to a recording section and a capping position;

a capping member for sealingly capping said recording head when said recording head is in said capping position;

a suction pump for applying a negative pressure to said capping member;

a power switch;

a power source control circuit that controls a supply of electric power from a power source circuit by said power switch;

power-off time detector that detects a power-off time elapsing after an instruction to stop the supply of electric power is issued by said power switch; and a control circuit, which is operably connected to said power switch and said power-off time detector, wherein said control circuit moves said carriage to place said recording head in said capping position such that said recording head is capped with said capping member when the instruction to stop the supply of electric power is issued by said power switch, wherein, when the power-off time exceeds a predetermined time, said control circuit stops the supply of electric power from said power source circuit.

2. The ink jet recording apparatus according to claim 1, wherein said control circuit further comprises:

a power on/off indicator that determines whether or not the supply of electric power is being supplied from said power source circuit and outputs a signal to said power-off time detector when the supply of electric power is not being supplied.

3. The ink jet recording apparatus according to claim 1, further comprising:

a print buffer that is operably connected to said control circuit and that stores print data, wherein, when the instruction to stop the supply of electric power is issued by said power switch, said control circuit resets said print data stored in said print buffer, and holds said carriage motor for a fixed time in a state in which said recording head is sealed with said capping member.

4. The ink jet recording apparatus according to claim 3, wherein, when the instruction to stop the supply of electric power is issued by said power switch, said control circuit causes a power on/off indicator to indicate a power off state, and after the fixed time elapses, said control circuit removes the holding state of said carriage motor.

5. The ink jet recording apparatus according to claim 4, wherein, when the instruction to supply the electric power is issued by said power switch before the fixed time elapses, said control circuit continues the holding state of said carriage motor and restarts control.

6. A method for controlling supplying electric power to an ink jet recording apparatus, comprising the steps of:

(a) moving a carriage to a sealing position where a recording head is capped with a capping member when an instruction to stop supplying the electric power is issued by a power switch;

(b) counting a time from when the instruction was issued; and (c) when the time counted exceeds a predetermined time, stopping the supply of the electric power from a power source circuit.

7. The method for controlling supplying electric power according to claim 6, further comprising the steps of:

(d) when the instruction to stop the supply of electric power is issued by said power switch, resetting print data stored in a print buffer; and (e) holding a carriage motor for a fixed time in a holding state such that said recording head is sealed with said capping member.

8. The method for controlling supplying electric power according to claim 7, further comprising the steps of:

(f) when the instruction to stop the supply of electric power is issued by said power switch, indicating a power off state; and (g) after the fixed time elapses, removing the holding state of said carriage motor.

9. The method for controlling supplying electric power according to claim 8, further comprising:

(h) when an instruction to supply electric power is issued by said power switch before the fixed time elapses, restarting controlling said carriage motor with maintaining the holding state of said carriage motor.

* * * * *